United States Patent [19]

Someya et al.

[11] Patent Number: 4,582,519

[45] Date of Patent: Apr. 15, 1986

[54] GAS-LIQUEFYING SYSTEM INCLUDING CONTROL MEANS RESPONSIVE TO THE TEMPERATURE AT THE LOW-PRESSURE EXPANSION TURBINE

[75] Inventors: Kazuo Someya; Yasuo Tasaka, both of Kudamatsu, Japan

[73] Assignee: Hitachi, Ltd., Tokyo, Japan

[21] Appl. No.: 638,580

[22] Filed: Aug. 7, 1984

[30] Foreign Application Priority Data

Sep. 14, 1983 [JP] Japan ..... 58-168118

[51] Int. Cl.[4] ..... F25J 1/00

[52] U.S. Cl. ..... 62/37; 62/9; 62/38

[58] Field of Search ..... 62/8, 9, 36, 37, 38, 62/40

[56] References Cited

U.S. PATENT DOCUMENTS 3,355,901 12/1967 Angerhofer ..... 62/38
3,358,460 12/1967 Smith et al. ..... 62/38
3,905,201 9/1975 Coveney et al. ..... 62/38

FOREIGN PATENT DOCUMENTS 49-40547 2/1974 Japan .

*Primary Examiner*—S. Leon Bashore

*Assistant Examiner*—Andrew J. Anderson

*Attorney, Agent, or Firm*—Antonelli, Terry & Wands

[57] ABSTRACT

A gas liquefying system of the type in which a compressed gas is divided into a part which is to be used for the generation of cold heat and a part which is to be liquefied, the part of the gas for generation of cold heat being introduced into a high-pressure expansion turbine to generate the cold heat and, after an adjustment of the temperature thereof at the outlet of the high-pressure expansion turbine, supplied to a low-pressure expansion turbine to further generate the cold heat while becoming the returning gas of a low temperature, the returning gas being supplied to a liquefier to liquefy the part of gas to be liquefied. The system comprises a temperature controlling means disposed in a pipe connected between the outlet of the high-pressure expansion turbine and the inlet of the low-pressure expansion turbine and adapted to raise the temperature of the gas at the outlet of the high-pressure expansion turbine, and means for adjusting the flow rate of the gas introduced to the temperature controlling means in response to the gas temperature at the inlet or the outlet of the low-pressure expansion turbine thereby optimumly regulating the gas temperature at the outlet of the low-pressure expansion turbine.

2 Claims, 3 Drawing Figures

GAS-LIQUEFYING SYSTEM INCLUDING CONTROL MEANS RESPONSIVE TO THE TEMPERATURE AT THE LOW-PRESSURE EXPANSION TURBINE

BACKGROUND OF THE INVENTION

The present invention relates to a gas liquefying system for gases having extremely low boiling temperature such as nitrogen, oxygen and so forth separated from air by an air separator or the like apparatus and, more particularly, to a gas liquefying system which liquefies gases of the kind mentioned above by using, as a cold heat source, a dual stage expansion turbine having a high-pressure stage turbine and a low-pressure stage turbine.

Japanese Patent Publication No. 40547/1974, for example, discloses a gas liquefying system which can liquefy gases having extremely low boiling temperatures such as oxygen, nitrogen or the like at a high efficiency, by using a dual stage expansion turbine having a high-pressure expansion turbine and low-pressure expansion turbine.

In general, when the liquefied gas as the product is supplied to a storage tank or the like, it is necessary to reduce the pressure of the liquefied gas to a considerably low level. Therefore, if the liquefied gas has not been super-cooled sufficiently, a part of the liquefied gas may evaporate. Namely, in order to prevent the flushing loss, it is essential to super-cool the product liquefied gas to a temperature which is equal to the saturation temperature after the pressure reduction. To this end, the gas temperature at the outlet from the low-pressure expansion turbine has to be decreased to a level not higher than the above-mentioned saturation temperature. An extreme low temperature at the outlet from the low-pressure expansion turbine, however, causes a part of the gas expanded through the turbine to be liquefied to generate mist. In general, the expansion turbine operates at a high speed of several tens of thousand revolution per minute. The liquid mist suspended by the gas, therefore, impinges upon the turbine blade to cause a rapid wear and unbalance of mass of the rotary part of the turbine, resulting in a breakdown of the turbine in the worst case. In order to obviate this problem, Japanese Patent Publication No. 40547/1974 proposes a method in which a part of the gas at the inlet to the high-pressure expansion turbine is introduced directly to the inlet side of the low-pressure expansion turbine thereby to control the gas temperature at the outlet from the low-pressure expansion turbine.

On the other hand, the temperature and the pressure of the gas at the inlet to the expansion turbine are preferably high, in order to attain a large theoretical adiabatic heat drop, from the view point of theory of thermodynamics. It is, therefore, preferred to elevate the gas temperature at the turbine inlet within the range allowed by the heat exchanger, for attaining a high efficiency of the gas liquefying system.

A conventional gas liquefying system employing a combination of high- and low-pressure expansion turbine will be explained hereinunder with reference to FIG. 1.

Referring to FIG. 1, the conventional gas liquefying system has a circulation type compressor 1 for compressing nitrogen gas, a pre-cooler 2, a cooler 3 making use of Freon or the like refrigerant, a heat exchanger 4, a liquefier 5, a high-pressure expansion turbine 6, a low-pressure expansion turbine 7, a liquefied gas discharge valve 8, a pipe 9 through which a part of the nitrogen gas cooled in the heat exchanger is introduced to the high-pressure expansion turbine for generating the cold heat, a pipe 10 through which the remainder of the gas is introduced as a liquefying gas to the liquefier 5, and a pipe 11 connecting the outlet of the high-pressure expansion turbine 6 to the low-pressure expansion turbine 7 past the liquefier 5.

In operation, after being compressed to a pressure of about 35 $Kg/cm^2$ G by the circulation type compressor 1, the nitrogen gas is cooled through the pre-cooler 2 and the cooler 3, and is further cooled through the heat exchanger 4 by the returning gaseous nitrogen down to a low temperature of about −100° C. The nitrogen gas then shunts into two parts. A first part of this compressed nitrogen gas is introduced into the high-pressure expansion turbine 6 through the pipe 9 and is expanded to a mean pressure of about 5 $Kg/cm^2$ to generate a cold heat of about −160° C. This cold nitrogen gas is introduced to the liquefier 5 in which the temperature of the gas is raised to about −150° C. The gas is then introduced to the low-pressure expansion turbine 7 and expanded to a pressure of about 0.3 $Kg/cm^2$ G to generate a cold heat of about −190° C. The nitrogen gas of low temperature and pressure from the low-pressure turbine 7 is introduced to the liquefier 5. Meanwhile, the other part of the high-pressure liquefaction gas, shunted at the outlet of the heat exchanger 4, is introduced to the liquefier 5 and is liquefied and super-cooled by the cold heat of the low pressure and temperature nitrogen gas coming from the low-pressure expansion turbine 7. The nitrogen gas of low temperature and pressure then cools the high-pressure nitrogen gas flowing through the heat exchanger 4 and, after recovering the temperature through the heat exchange with the high-pressure gas, returns to the circulation type compressor 1 through the pre-cooler 2. On the other hand, the nitrogen gas of high pressure now liquefied in the liquefier 5 is super-cooled to the saturation temperature of the product gas while it flows through the downstream part of the liquefier 5 and is picked up as the product liquid nitrogen through the liquefied gas discharge valve 8. The product gas is then stored in a storage tank or used as the cold heat source for a rectification tower such as an air separator. Hitherto, the temperature regulation of the gas at the outlet from the low-pressure expansion turbine 7 is conducted by means of a temperature regulator 13 which operates the liquefied gas discharge valve 8 in response to a signal from a temperature sensor adapted to sense the gas temperature at the outlet side of the low-pressure expansion turbine 7. When the system operates with reduced quantity of the nitrogen gas or when the temperature adjustment by the liquefied gas is not available fully, the temperature regulation is conducted with the assist by the method proposed in Japanese Patent Publication No. 40547 mentioned before.

In this conventional method of regulating the temperature of the liquefied gas, the gas temperature at the inlet to the low-pressure expansion turbine, recovered by the liquefier 5, is changed depending on the flowrate of the high-pressure gas to be liquefied which in this case serves as the hot heat exchanging medium. Partly because the heat transfer area of the liquefier 5 is unchangeable and partly because the temperature at the output from the low-pressure expansion turbine 7 is controlled preferentially, the temperature of the liquid nitrogen taken out of the liquefier 5 as the product is largely changed by the fluctuation of the flow rate of the gas to be liquefied. At the same time, the temperature at the inlet to the high-pressure expansion turbine 6 is affected.

The rise in the temperature of the liquefied nitrogen causes an increase in the flushing loss, to waste the nitrogen unnecessarily, resulting in a reduction of the efficiency. The method disclosed in Japanese Patent Publication No. 40547/1974, consisting in directly supplying a part of the gas from the inlet side of the high-pressure expansion turbine 6, is effective from the view point of protection of the low-pressure expansion turbine 7, but causes a loss of energy to decrease the overall efficiency of the liquefying system undesirably.

SUMMARY OF THE INVENTION

Accordingly, an object of the invention is to provide a control means for a gas liquefying system, capable of optimumly regulating the temperature of the gas at the outlet from the low-pressure expansion turbine without affecting the gas temperature at the inlet to the high-pressure expansion turbine and the final cooling temperature of the liquefied gas.

To this end, according to the invention, there is provided a gas control means of a liquefying system of the type described, wherein a temperature controlling means is disposed in a pipe connected between the outlet of the high-pressure expansion turbine and the inlet of the low-pressure expansion turbine and adapted for raising the temperature of the gas at the outlet of the high-pressure expansion turbine, and means for controlling the flow rate of the gas introduced to the temperature controlling means in response to the gas temperature at the inlet or the outlet of the low-pressure expansion turbine, thereby optimumly regulating the gas temperature at the outlet of the low-pressure expansion turbine.

The present invention also provides for control means for a gas liquefying system, including a heat exchanger for turbine gas (that is, gas passing through both turbines) for regulating the temperature of the turbine gas at the outlet of the high-pressure expansion turbine, with a pipe connected between the outlet of the high-pressure expansion turbine and the inlet of the low-pressure expansion turbine passing through such heat exchanger, and with a part of the gas for liquefying also being passed through the heat exchanger for turbine gas; and means for automatically regulating the flow rates of the liquefying gases which are introduced to the heat exchanger for turbine gas and passed through a liquefier, such means including control valves operated by detecting the temperature of the gas at the outlet of the low-pressure expansion turbine, and wherein the temperature of the gas at the inlet of the high-temperature turbine is automatically regulated at an optimum temperature.

The above and other objects, features and advantages of the invention will become more clear from the following description of the preferred embodiments of the invention when the same is read in conjunction with the accompanying drawings.

BRIEF DESCRIPTION OF THE DRAWINGS

An embodiment of the invention will be described hereinunder with specific reference to FIG. 2. In this Figure, the same reference numerals are used to denote the same parts or members as those used in FIG. 1 and detailed description of such parts or members are omitted.

Figure 2:
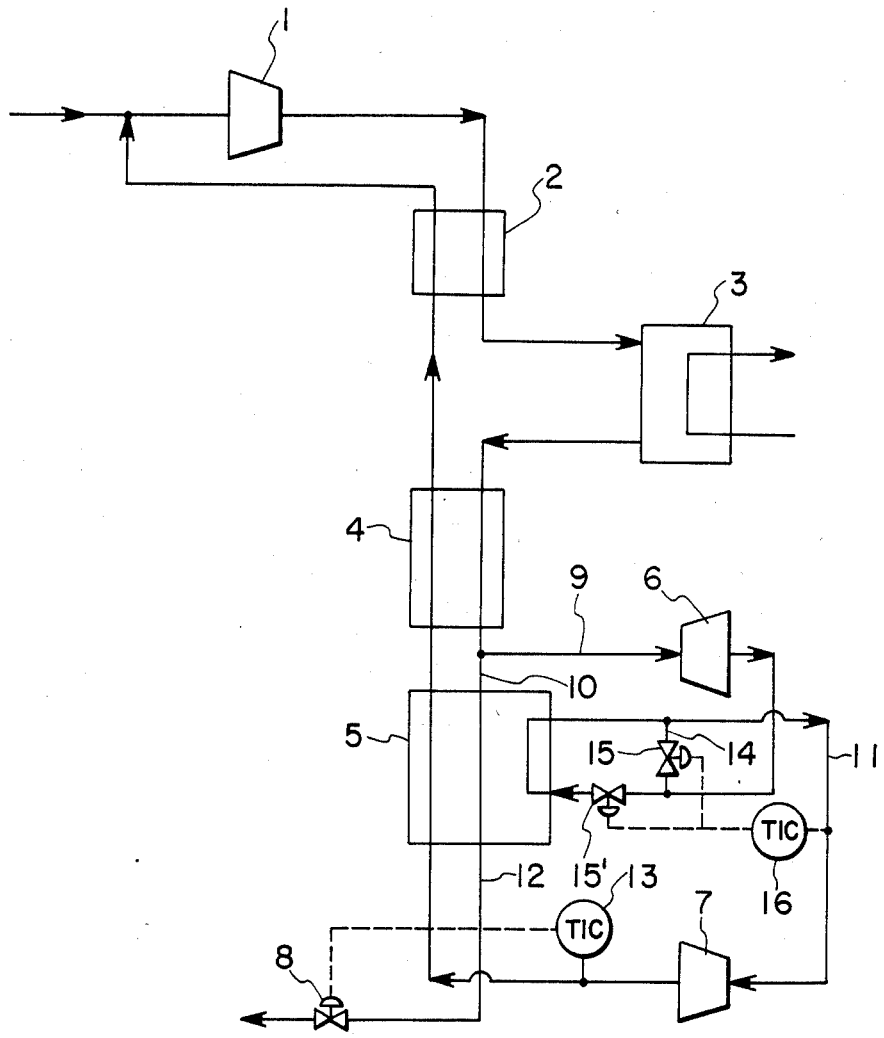
FIG. 2 is a block diagram of an embodiment of a gas liquefying system in accordance with the invention.

The liquid liquefying system shown in FIG. 2 employs a liquefier 5 as the temperature regulating means for raising the gas temperature at the outlet from the high-pressure expansion turbine 6. A by-pass pipe 14 is disposed to connect the outlet side of the high-pressure expansion turbine 6 and the inlet side of the low-pressure expansion turbine 7. The by-pass pipe 14 is provided with an automatic controlling valve for automatically controlling the flow-rate of the gas flowing in the by-pass pipe 14, in response to a signal from a temperature regulating means having a sensor capable of sensing the gas temperature at the inlet side of the low-pressure expansion turbine 7.

The basic arrangement is such that the temperature regulating means 16, upon sensing the gas temperature at the inlet side of the low-pressure expansion turbine 7, actuates the automatic controlling valve 15 to control the flow rate of the gas in the by-pass pipe 14 such that the aimed optimum gas temperature is maintained at the outlet side of the low-pressure expansion turbine 7. In this case, since the gas temperature at the outlet side of the low-pressure expansion turbine 7 is controlled by the gas coming from the high-pressure expansion turbine 6, the gas temperature at the inlet to the high-pressure expansion turbine 6 is never affected by this control.

In a modification of this embodiment, an automatic control valve 15' is disposed in the pipe 11 at the inlet side or the outlet side of the liquefier 5, in addition to the control valve 15 in the by-pass pipe 14. With such an arrangement, it is possible to control the gas temperature at the inlet to the low-pressure expansion turbine 7 at a higher precision.

As has been described, according to the first embodiment of the invention, the liquefier serving as a temperature controller for raising the gas temperature at the outlet from the high-pressure expansion turbine is disposed at an intermediate portion of the pipe through which the outlet of the high-pressure expansion turbine is connected to the inlet of the low-pressure expansion turbine, and the automatic control valve is disposed in the by-pass pipe which by-passes the liquefier. The automatic control valve is actuated by a temperature regulating means which operates upon sensing the gas temperature at the inlet side or the outlet side of the low-pressure expansion turbine, whereby the gas temperature at the outlet side of the low-pressure expansion turbine is regulated through the control of flow rate of the gas in the by-pass pipe.

It is thus possible to regulate the gas temperature at the outlet side of the low-pressure expansion turbine without affecting the gas temperature at the inlet side of the high-pressure expansion turbine.

Figure 1:
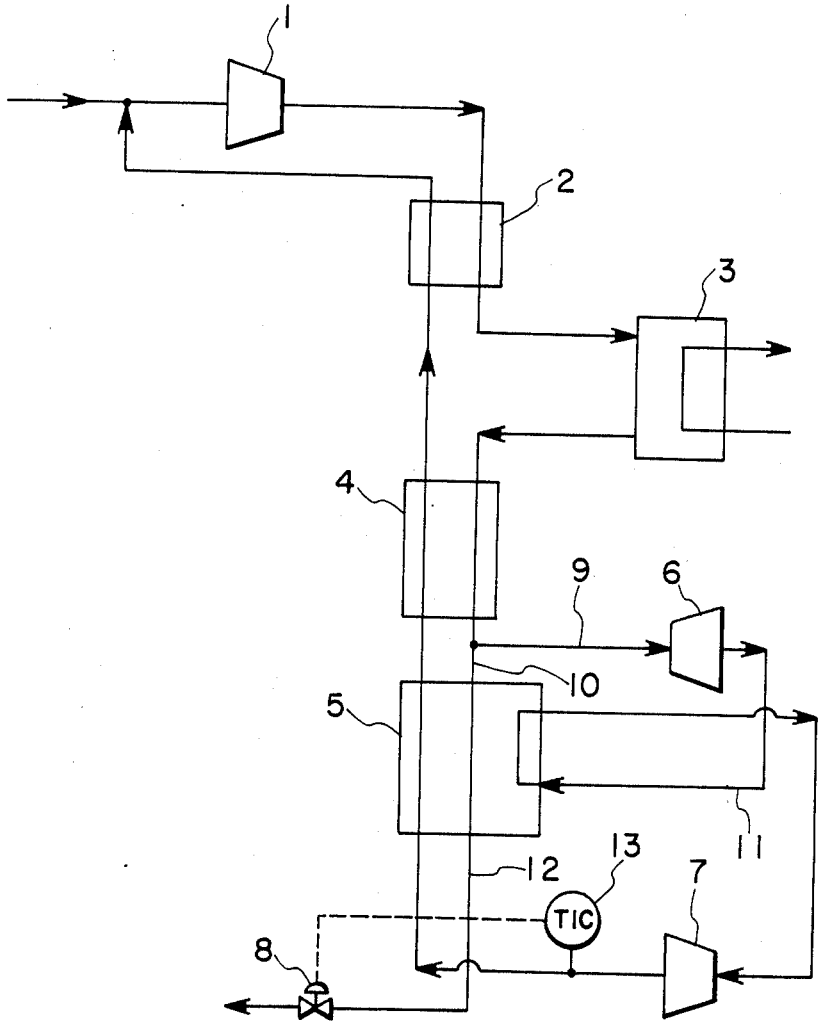
FIG. 1 PRIOR ART
FIG. 1 is a system diagram of an example of conventional systems for liquefying nitrogen gas.
Figure 3:
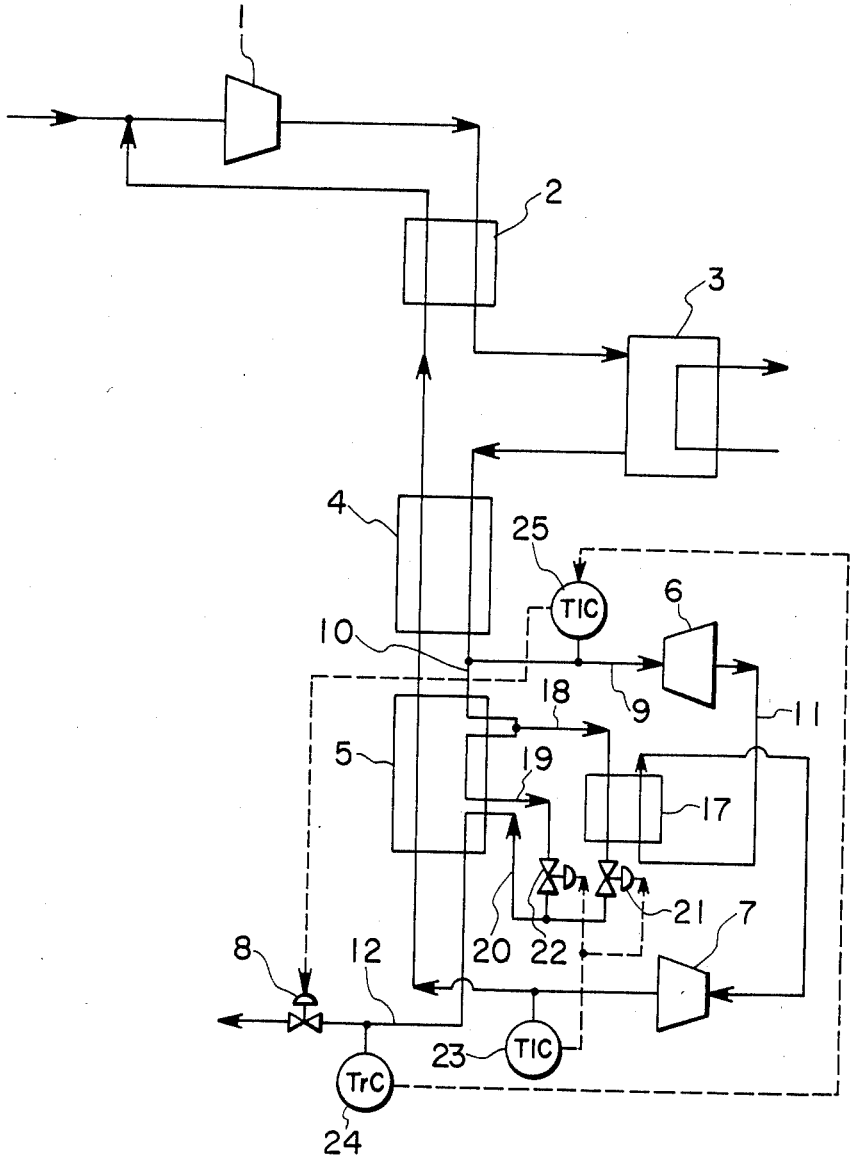
FIG. 3 is a block diagram of another embodiment of the gas liquefying system in accordance with the invention.

FIG. 3 shows another embodiment of the gas liquefying system in accordance with the invention. In this Figure, the same reference numerals are used to denote the same parts or members as those used in FIG. 1, so that detailed description of such parts or members will not be needed. In this embodiment, a turbine heat exchanger 17 is used as the temperature regulator for raising the gas temperature at the outlet of the high-pressure expansion turbine 6. To this end, the turbine heat exchanger 17 is disposed at an intermediate portion of a pipe 11 connected between the outlet of the high-pressure expansion turbine 6 and the inlet side of the low-pressure expansion turbine 7. A reference numeral 18 denotes a pipe through which a part of the gas for liquefaction, available at the upstream side of the liquefier 5, is introduced into the turbine heat exchanger 17, while 19 designates a pipe through which the gas for liquefaction is picked up from an intermediate portion of the liquefier 5. A reference numeral 20 designates a pipe through which the parts of the gas for liquefaction coming from the pipes 18 and 19 merge in each other and introduced to the downstream portion of the liquefier 5. The pipes 18 and 19 are provided with automatic control valves 21 and 22, respectively. These automatic control valves 21 and 22 are actuated by a temperature regulating means 23 which operates in response to the gas temperature at the outlet side of the low-pressure expansion turbine 7. A reference numeral 24 designates an automatic adjust device which adjust the gas temperature at the inlet side of the high-pressure expansion turbine 6 upon sensing the liquefied gas outlet temperature.

The nitrogen gas of high-pressure discharged from the heat exchanger 4 is divided into two parts: namely, a part which is to be used as the source of the cold heat and a part for liquefying. The first-mentioned nitrogen gas part is introduced into the high-pressure expansion turbine by way of the conduit 9 and then the nitrogen gas generated cold heat is introduced into the heat-exchanger 17 for turbine gas, provided at an intermediate portion of the conduit 11. On the other hand the second-mentioned part of the nitrogen gas (that is, the part for liquefying and which is introduced into the liquefier 5) is further divided into two portions; one of such two portions is introduced into heat exchanger 17, for turbine gas, through the conduit 18. Such portion of the nitrogen gas introduced through the pipe 18 into the turbine heat-exchanger 17 is introduced so as to make a heat exchange with the cold-heat generating nitrogen gas which has been cooled through the high-pressure expansion turbine 6. Thus, in the heat exchanger 17, the nitrogen gas which is used for the generation of cold heat and cooled by the high-pressure expansion turbine 6, an the nitrogen gas for liquefying, have their heat exchanged, the temperature of the nitrogen gas for the generation of cold heat being raised to a predetermined temperature; and the nitrogen gas for the generation of cold heat is then introduced into the low-pressure expansion turbine 7. The portion of the nitrogen gas for liquefying which passes through heat exchanger 17 is cooled therein and then is mixed with the rest of the second-mentioned part (which is passed through the liquefier 5 and cooled, and introduced therefrom into the conduit 19) in the conduit 20, after the respective portions of the second-mentioned part pass through the automatic control valves 21 and 22. The mixed gas is again introduced to the liquefier 5, at the rear flow side thereof, and is heat exchanged with the nitrogen gas having cold heat which was generated by the low-pressure expansion turbine 7. Thereafter a liquefied gas is obtained, through the conduit 12 and the outlet valve 8, which is the final product of the apparatus.

The temperature of the nitrogen gas at the low-pressure expansion turbine 7 is optimumly regulated through the control of the flow rate of the nitrogen gas to be liquefied, introduced into the turbine heat-exchanger 17, by the operation of the automatic temperature control valves 21 and 22 under the control of the automatic temperature controlling means 23 which in turn operates in response to the temperature of the nitrogen gas at the outlet side of the low-pressure expansion turbine 7.

As can be appreciated, the temperature of the liquefied gas which is the final product of the apparatus will vary depending on the operation mode such as a decreasing output operation. However, with the present apparatus, the temperature is automatically controlled at a predetermined temperature at all times by increasing or decreasing the flow rate of the gas which is obtained as the final product of the apparatus through the outlet valve 8, together with increasing or decreasing the generating rate of the cold heat from the high-pressure expansion turbine 6 and the low-pressure expansion turbine 7; by increasing or decreasing the gas flow rate in response to the temperature of the nitrogen gas for the generation of the cold heat introduced into the high-pressure expansion turbine 6; and by automatically controlling the set value of the automatic temperature controlling means 25 provided in the conduit 9 at the inlet side of the high-pressure expansion turbine 6 in response to the temperature of the liquefied gas which is obtained by detecting the temperature of the liquefied gas at the outlet of the liquefier 5 by means of the automatic temperature regulating means 24 provided in the conduit 12.

In the embodiment described hereinabove, the automatic control valves 21 and 22 are actuated in response to the temperature of the nitrogen gas at the outlet side of the low-pressure expansion turbine 7. This, however, is not exclusive and the same result can be obtained by operating the automatic control valves 21 and 22 in response to the nitrogen gas at the inlet side of the low-pressure expansion turbine 7.

As has been described, in the second embodiment of the invention, the temperature controller for raising the temperature of the gas at the outlet side of the high-pressure expansion turbine is constituted by a heat exchanger, for gas passing through the turbines, disposed in the pipe connecting the outlet of the high-pressure expansion turbine and the inlet of the low-pressure expansion turbine. In operation, a part of the gas to be liquefied is introduced into this heat exchanger to serve as the temperature-controlling high-temperature medium, while controlling the flow rate of the gas to be liquefied into this heat exchanger and the flow rate of the liquefied gas flowing through the liquefier by respective automatic control valves.

It is, therefore, possible to optimumly control and regulate the gas temperature at the outlet of the low-pressure expansion turbine without substantially affecting the gas temperature at the inlet side of the high-pressure expansion turbine. Furthermore, since the temperature of the gas at the inlet to the high-pressure gas turbine is automatically controlled in response to the product liquefied gas at the outlet from the liquefier, it is possible to set an optimum operating condition which allows the gas liquefying system to operate with reduced loss of energy.

What is claimed is:

1. A gas liquefying system of the type in which a gas compressed by a circulation type compressor is cooled in a heat exchanger through a heat exchange with a returning gas of a low temperature, the cooled gas being then divided into a part which is to be used for the generation of cold heat and a part which is to be liquefied, the part of the gas for generation of cold heat being introduced into a high-pressure expansion turbine to generate the cold heat and, after an adjustment of the temperature thereof at the outlet of said high-pressure expansion turbine, supplied to a low-pressure expansion turbine to further generate the cold heat while becoming the returning gas of a low temperature, said returning gas being supplied to a liquefier to liquefy said part of gas to be liquefied and returned to said circulation type compressor after a recovery of temperature through a heat exchanger in said heat exchanger, said system comprising: a heat exchanger, for gas passing through the turbines, disposed in the pipe between the outlet of said high-pressure expansion turbine and the inlet of said low-pressure expansion turbine and adapted for raising the temperature of the gas coming from said high-pressure expansion turbine; a first branch pipe and a second branch pipe for the gas to be liquefied, said first and second branch pipes shunting from each other at an upstream portion of said liquefier, said first branch pipe leading through said heat exchanger for gas passing through the turbines and merging in said second branch pipe at the downstream portion of said liquefier; automatic control valves disposed in said first and second branch pipes, respectively; and an automatic temperature controlling means for actuating said first and second automatic control valves upon sensing the gas temperature at the inlet or the outlet of said low-pressure expansion turbine.

2. A gas liquefying system of the type in which a gas compressed by a circulation type compressor is cooled in a heat exchanger through a heat exchange with a returning gas of a low temperature, the cooled gas being then divided into a part which is to be used for the generation of cold heat and a part which is to be liquefied, the part of the gas for generation of cold heat being introduced into a high-pressure expansion turbine to generate the cold heat and, after an adjustment of the temperature thereof at the outlet of said high-pressure expansion turbine, supplied to a low-pressure expansion turbine to further generate the cold heat while becoming the returning gas of a low temperature, said returning gas being supplied to a liquefier to liquefy said part of gas to be liquefied and returned to said circulation type compressor after a recovery of temperature through a heat exchange in said heat exchanger, said system comprising: a heat exchanger, for gas passing through the turbines, disposed in the pipe between the outlet of said high-pressure expansion turbine and the inlet of said low-pressure expansion turbine and adapted for raising the temperature of the gas coming from said high-pressure expansion turbine; a first branch pipe and a second branch pipe for the gas to be liquefied, said first and second branch pipes shunting from each other at an upstream portion of said liquefier, said first branch pipe leading through said heat exchanger for gas passing through the turbines and merging in said second branch pipe at the downstream portion of said liquefier; automatic control valves disposed in said first and second branch pipes, respectively; an automatic temperature controlling means for actuating said first and second automatic control valves upon sensing the gas temperature at the inlet or the outlet of said low-pressure expansion turbine; a temperature controller disposed in the pipe for introducing the gas for generation of cold heat to said high-pressure expansion turbine and adapted to control the temperature of the gas at the inlet of said high-pressure expansion turbine; and an automatic controller disposed in the pipe for the gas to be liquefied leading from the outlet of said temperature controller and for automatically adjusting the command temperature set in said temperature controller in response to the temperature of the product liquefied gas.

* * * * *